US009050630B2

(12) United States Patent
Kozawa et al.

(10) Patent No.: US 9,050,630 B2
(45) Date of Patent: Jun. 9, 2015

(54) POWDER-CLASSIFICATION METHOD

(75) Inventors: Kazumi Kozawa, Fujimino (JP); Kosuke Ando, Fujimi (JP); Daisuke Sato, Yoshimi (JP)

(73) Assignee: NISSHIN SEIFUN GROUP INC., Tokyo (JP)

( * ) Notice: Subject to any disclaimer, the term of this patent is extended or adjusted under 35 U.S.C. 154(b) by 0 days.

(21) Appl. No.: 14/003,684

(22) PCT Filed: Feb. 24, 2012

(86) PCT No.: PCT/JP2012/054558

§ 371 (c)(1),
(2), (4) Date: Sep. 6, 2013

(87) PCT Pub. No.: WO2012/124453

PCT Pub. Date: Sep. 20, 2012

(65) Prior Publication Data

US 2014/0027353 A1 Jan. 30, 2014

(30) Foreign Application Priority Data

Mar. 16, 2011 (JP) ..... 2011-058274

(51) Int. Cl.

| | |
|---|---|
| ***B07B 7/08*** | (2006.01) |
| ***B07B 4/08*** | (2006.01) |
| ***B07B 7/086*** | (2006.01) |

(Continued)

(52) U.S. Cl.

CPC ... *B07B 7/08* (2013.01); *B03B 9/00* (2013.01); *B07B 9/00* (2013.01); *B07B 4/02* (2013.01); *B07B 11/00* (2013.01); *B07B 4/00* (2013.01);

(Continued)

(58) Field of Classification Search

CPC ..... B03B 9/00; B07B 9/00; B07B 4/00; B07B 4/02; B07B 11/00; B07B 11/08

USPC ..... 209/3, 20, 44.1, 44.2

See application file for complete search history.

(56) References Cited

U.S. PATENT DOCUMENTS 8,925,398 B2 * 1/2015 Kozawa et al. ..... 73/865.5
2006/0219056 A1 * 10/2006 Larink ..... 75/338

(Continued)

FOREIGN PATENT DOCUMENTS

JP A-64-085149 3/1989
JP 2010-079051 A 4/2010

(Continued)

OTHER PUBLICATIONS

International Preliminary Report on Patentability issued in International Application No. PCT/JP2012/054558 dated Sep. 17, 2013 (w/ translation).

(Continued)

*Primary Examiner* — Stefanos Karmis
*Assistant Examiner* — Howard Sanders
(74) *Attorney, Agent, or Firm* — Oliff PLC

(57) ABSTRACT

A powder-classification method includes a mixing step in which a powder and a liquid additive are mixed together, a drying step in which the powder mixed in the mixing step is dried, a loading step in which the powder dried in the drying step is loaded into a fluid classifier, a heating step in which a gas is heated, a supplying step in which the gas heated in the heating step is supplied to the fluid classifier, and a classifying step in which the powder is classified in the fluid classifier based on a grain size of the powder.

11 Claims, 5 Drawing Sheets

(51) Int. Cl.

| | |
|---|---|
| *B03B 9/00* | (2006.01) |
| *B07B 9/00* | (2006.01) |
| *B07B 4/02* | (2006.01) |
| *B07B 11/00* | (2006.01) |
| *B07B 4/00* | (2006.01) |
| *B07B 11/08* | (2006.01) |

(52) U.S. Cl.
CPC . *B07B 11/08* (2013.01); *B07B 4/08* (2013.01); *B07B 7/086* (2013.01)

(56) References Cited

U.S. PATENT DOCUMENTS

| | | | | |
|---|---|---|---|---|
| 2009/0032443 | A1* | 2/2009 | Taketomi et al. | 209/135 |
| 2010/0165447 | A1 | 7/2010 | Komatsu et al. | |
| 2011/0219854 | A1 | 9/2011 | Kozawa et al. | |
| 2012/0318042 | A1* | 12/2012 | Kozawa et al. | 73/28.01 |

FOREIGN PATENT DOCUMENTS

| | | | |
|---|---|---|---|
| JP | 2010-156785 | A | 7/2010 |
| WO | WO 2010/047175 | A1 | 4/2010 |

OTHER PUBLICATIONS

International Search Report issued in Application No. PCT/JP2012/054558; Dated Apr. 3, 2012 (With Translation).
Nov. 11, 2014 Office Action issued in Japanese Application No. 2013-504630 (with translation).
Feb. 17, 2015 Decision of Rejection issued in Japanese Application No. 2013-504630.

* cited by examiner

POWDER-CLASSIFICATION METHOD

TECHNICAL FIELD

The present invention relates to a powder-classification method for efficiently classifying a powder, having a particle size distribution, in a desired classification-point (grain size).

BACKGROUND ART

A classification method is known, in which a fluid additive such as alcohols is added when classifying a powder such as vitreous blast furnace slag into a fine powder and a coarse powder (for example, see Patent literature 1). In this classification method, an additive including a polar molecule is added to a powder to electrically neutralize a polarity of a powder particle so as to prevent adsorption and aggregation of particles to form an aggregated particle having a large grain size, and thereby to prevent deterioration in classification efficiency.

CITATION LIST

Patent Literature

Patent Literature 1: JP S64-85149 A

SUMMARY OF INVENTION

Technical Problem

Nowadays, for example, a ceramic used as a dielectric of a laminated ceramic capacitor is produced by sintering a fine powder of barium titanate ($BaTiO_3$) having an average grain size extremely as small as 0.7 μm. In order to obtain a high quality ceramic, such fine powder, not only having an extremely small average grain size but also having an extremely narrow band of particle size distribution, in other words, a better homogenized fine powder, is necessary. Such a fine powder can be obtained by classifying a material or a powder by, for example, centrifugal separation. However, in a conventional classification method, a material or a powder sticks to portions in a classifier to block an ejection port for a high-pressure gas or a loading port for the material, which causes deterioration in performance of classification and makes a long time operation difficult.

An object of the present invention is to provide a powder-classification method by which a powder can efficiently be classified without causing sticking of a powder in a classifier even when classification is carried out for a powder having a grain size smaller than 1 μm.

Solution to Problem

A powder-classification method of the present invention is characterized by including: a mixing step in which a powder and a liquid additive are mixed together; a drying step in which the powder mixed in the mixing step is dried; a loading step in which the powder dried in the drying step is loaded into a fluid classifier; a heating step in which a gas is heated; a supplying step in which the gas heated in the heating step is supplied to the fluid classifier; and a classifying step in which the powder is classified in the fluid classifier based on a grain size of the powder.

Further, a powder-classification method of the present invention is characterized by including: a mixing step in which a powder and a liquid additive are mixed together; a drying step in which the powder mixed in the mixing step is dried; a loading step in which the powder dried in the drying step is loaded into a fluid classifier; a supplying step in which a gas is supplied to the fluid classifier; and a classifying step in which the powder is classified in the fluid classifier based on a grain size of the powder.

Further, the powder-classification method of the present invention is characterized in that a drying temperature and a period of time for drying in the drying step correspond to a flash point of the liquid additive.

Further, the powder-classification method of the present invention is characterized in that, in the heating step, the gas is heated so as a temperature in the fluid classifier to be at a flash point of the liquid additive or higher, and 200° C. or lower.

Further, the powder-classification method of the present invention is characterized in that the gas supplied in the supplying step is a high-pressure gas.

Further, the powder-classification method of the present invention is characterized in that the powder is classified in the classifying step by a swirling air stream produced in the fluid classifier.

Further, the powder-classification method of the present invention is characterized in that the liquid additive is diethylene glycol monomethyl ether.

Further, the powder-classification method of the present invention is characterized in that the powder is a powder of barium titanate.

Advantageous Effects of Invention

According to the powder-classification method of the present invention, a powder can efficiently be classified without causing sticking of a powder in a fluid classifier even when classification is carried out for a powder having a grain size smaller than 1 μm.

DESCRIPTION OF EMBODIMENTS

Figure 1:
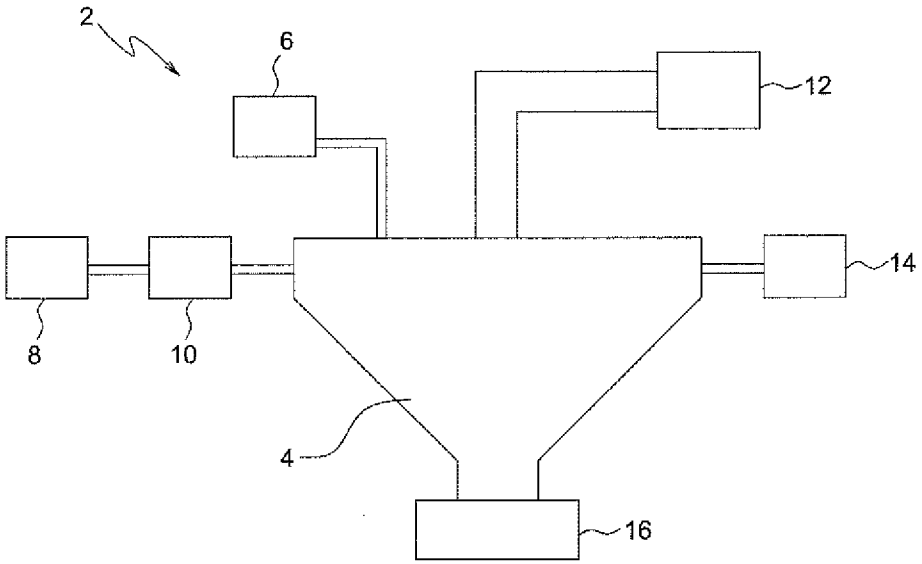
FIG. 1 is a schematic configuration view illustrating a configuration of a classifying apparatus according to a first embodiment.

A powder-classification method according to a first embodiment of the present invention will be described below referring to the drawings. FIG. 1 is a schematic configuration view illustrating a configuration of a classifying apparatus, which is a fluid classifier used in a powder-classification method according to the embodiment.

As illustrated in FIG. 1, a classifying apparatus 2 includes a classifier (fluid classifier) 4 which classifies a powder, loaded as a material, by a swirling air stream produced in the classifying apparatus 2, a feeder 6 which loads the powder into the classifier 4, a compressor 8 which supplies a high-pressure gas to the classifier 4, and a first heater 10 which heats the supplied high-pressure gas to a given temperature.

Further, the classifying apparatus 2 includes an inhale-blower 12 which collects a fine powder separated in a particle as small as, or smaller than, a desired classification-point by inhaling the fine powder together with a gas in the classifier 4, a second heater 14 which heats the atmospheric air (atmospheric pressure gas) inhaled by negative pressure produced in the classifier 4, and a collecting container 16 which collects a centrifugally separated coarse powder having a large grain size.

The classifier 4 having a generally conical shape is provided in a manner that the apex of the cone faces downward, and a centrifugation chamber 20 (see FIG. 2), which will be described in detail later, is formed in the upper portion of the classifier 4. The atmospheric air existing outside the classifier 4 as an atmospheric pressure gas and a high-pressure gas from the compressor 8 are supplied to the centrifugation chamber 20, and a powder to be classified is loaded from the feeder 6 into the centrifugation chamber 20.

The feeder 6 includes a screw therein, which is not shown in the drawing, and a powder contained in the feeder 6 can be transmitted at a constant flow rate by rotating the screw. The transmitted powder is loaded into the classifier 4 from a loading port 26 (see FIG. 2) provided on a top surface of the classifier 4. The powder contained in the feeder 6 is previously mixed together with a liquid additive which will be described later.

The compressor 8 compresses an atmospheric air to produce a high-pressure gas, and supplies the high-pressure gas to the inside of the classifier 4 via the first heater 10. The first heater 10 includes therein a tube in which the high-pressure gas flows. A heating means configured with a filament, an aerofin, or the like is provided inside the tube. By the heating means, the high-pressure gas flowing inside the tube is heated to a given temperature. Between the compressor 8 and the classifier 4, other method of dehydration for removing moisture from the high-pressure gas may additionally be provided, or a filter for removing dust or the like may suitably be provided.

The inhale-blower 12 collects a fine powder separated by the classifier 4, by inhaling the fine powder together with a gas existing in the classifier 4 from an inhaling port 32 (see FIG. 2) provided in the middle of the top surface of the classifier 4. A filter such as a bag filter may suitably be provided between the inhaling port 32 and the inhale-blower 12. When the inhale-blower 12 inhales a gas, negative pressure is produced in the classifier 4. Thereby, the atmospheric air existing outside the classifier 4, which is an atmospheric pressure gas, is inhaled into the classifier 4. By the atmospheric pressure gas inhaled in this manner, a swirling air stream swirling at a high speed is formed in the centrifugation chamber 20 of the classifier 4. Since the classifying apparatus 2 according to the embodiment includes a second heater 14 which heats the atmospheric pressure gas to be inhaled, the swirling air stream in the centrifugation chamber 20 can be heated to a given temperature. Similar to the first heater 10, the second heater 14 includes therein a tube in which the atmospheric pressure gas flows. A heating means such as a filament or an aerofin is provided inside the tube.

The collecting container 16 is provided in the most bottom portion of the classifier 4, and collects a coarse powder which is centrifugally separated in the centrifugation chamber 20 and then falls along the slope of the conical shape portion of the classifier 4.

Figure 2:
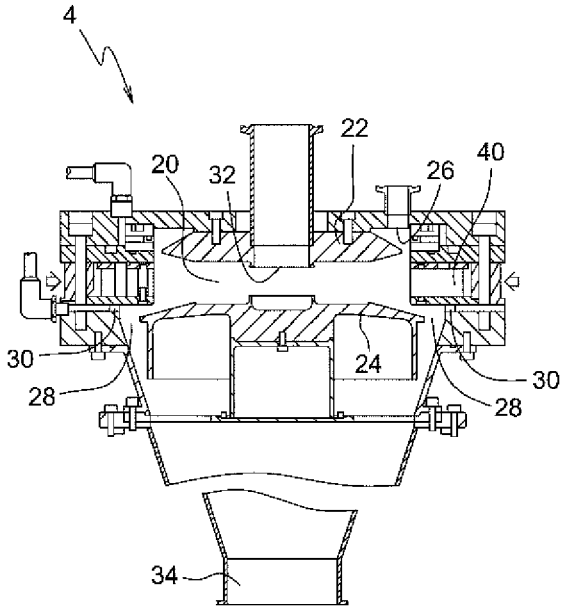
FIG. 2 is a longitudinal cross sectional view illustrating a configuration inside a classifier according to the first embodiment.
Figure 3:
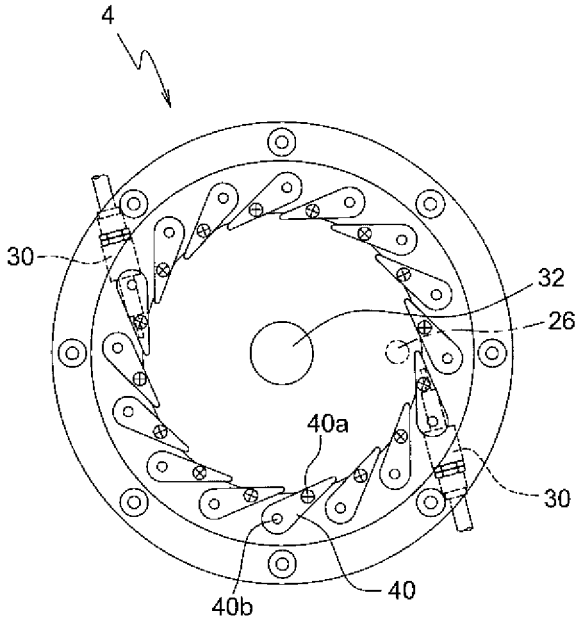
FIG. 3 is a cross sectional view illustrating the configuration inside the classifier according to the first embodiment.

The classifier 4 according to the embodiment will be described referring to FIGS. 2 and 3. FIG. 2 is a longitudinal cross sectional view taken along a plane including a central axis of the classifier 4. FIG. 3 is a cross sectional view taken along a plane, which is perpendicular to the central axis and located in the region where the centrifugation chamber 20 exists. In order to clarify the relative positional relation between other components (particularly, an ejection nozzle 30 and a guide vane 40 which will be described later), the loading port 26 and an ejection nozzle 30, which actually do not appear in FIG. 3, are illustrated in phantom lines and dotted lines. Only two of the ejection nozzles 30 are illustrated for the convenience of description.

As illustrated in FIG. 2, an upper disk-shaped member 22 having a flat disk shape and a lower disk-shaped member 24 having a hollow disk shape are arranged with a given distance between each other in the upper portion of the classifier 4. The centrifugation chamber 20 having a cylindrical shape is formed between both the disk-shaped members. On the upper part of the centrifugation chamber 20, the loading port 26 through which a powder to be loaded from the abovementioned feeder 6 passes is formed. As illustrated in FIG. 3, a plurality of guide vanes 40 is arranged in the outer circumference of the centrifugation chamber 20 at an even interval. On the lower part of the centrifugation chamber 20, a reclassification zone 28 is formed. The powder, which has fallen from the centrifugation chamber 20 along the outer circumference wall of the lower disk-shaped member 24 after being centrifugally separated, is blown back again into the centrifugation chamber 20 from the reclassification zone 28.

In the vicinity of the upper end portion of the cuter circumference wall of the reclassification zone 28, the ejection nozzle 30, which ejects a high-pressure gas supplied from the abovementioned compressor 8, is arranged in a manner that the direction of ejection generally matches the tangential direction of the outer circumference wall. The ejection nozzle 30 disperses the powder loaded from the loading port 26 by ejecting a high-pressure gas, and also supplementarily supplies a gas to the centrifugation chamber 20. The ejection nozzle 30 blows back a fine powder existing in the reclassification zone 28 to the centrifugation chamber 20. In the embodiment, the plurality of ejection nozzles 30 is arranged in the outer circumference wall of the reclassification zone 28, as an example. There is a degree of freedom in determining an arrangement and the number of the ejection nozzle 30.

In the middle of the upper portion of the centrifugation chamber 20, the inhaling port 32, by which a fine powder separated from a coarse powder by centrifugal separation is inhaled and collected, is provided. The centrifugally separated coarse powder falls from the reclassification zone 28 along the slope of the conical shape portion of the classifier 4, and is then ejected from a discharge port 34 provided in the most bottom portion of the classifier 4 to be collected in the abovementioned collecting container 16.

As illustrated in FIG. 3, the guide vane 40, which forms a swirling air stream in the centrifugation chamber 20 and can also control a swirl speed of the swirling air stream, is arranged in the outer circumference of the centrifugation chamber 20. In the embodiment, 16 of the guide vanes 40 are arranged, as an example. The guide vane 40 is rotatably supported between the upper disk-shaped member 22 and the lower disk-shaped member 24 by a rotation shaft 40*a*, and engaged with a rotation plate (rotation means), which is not shown in the drawing, with a pin 40*b*. It is configured that all the guide vanes 40 simultaneously rotate at a given angle by rotating the rotation plate. As described above, each gap between the guide vanes 40 is controlled by rotating the guide vane 40 at a given angle. Thereby, the flow speed of the atmospheric pressure gas passing through the gap in the direction indicated by the white arrow shown in FIG. 2 is changed, and whereby, the flow speed of the swirling air stream in the centrifugation chamber 20 can be changed. By changing the flow speed of the swirling air stream, the performance of classification (particularly, a classification-point) of the classifier 4 according to the embodiment can be varied. As described above, the atmospheric pressure gas passing through each of the gaps between the guide vanes 40 is an atmospheric pressure gas which is previously heated to a given temperature by the second heater 14.

A powder-classification method according to the embodiment will be described referring to the flowchart in FIG. 4. First, a powder to be classified and a liquid additive are mixed together (step S10). Then, the liquid additive is vaporized by drying the mixture of the powder and the liquid additive (step S12).

The powder to be classified may be barium titanate or nickel. The liquid additive may be, for example, an alcohol such as ethanol, diethylene glycol monomethyl ether. As for a mixing ratio, when expressed in a normal mass ratio, 0.01 to 0.15, preferably 0.03 to 0.1, of a liquid additive is added to and mixed together with 1 of a powder. When the mixing ratio does not satisfy the range described above, such a problem occurs that the effect of the liquid additive does not appear, or fluidity of the powder decreases significantly.

As for a method of mixing, a stirring using a stirring chip and a magnetic stirrer, a planetary stirrer, a two-axis stirrer, a stirrer using three rolls, or the like may be used. In the embodiment, a mixer (Hi-X, manufactured by Nisshin Engineering Co., Ltd.) is used.

As for a method of drying, natural drying in the room temperature or drying using a thermostat oven may be used. As for a drying condition, such condition may suitably be selected according to a combination of a powder and a liquid additive, particularly, according to a flash point of a liquid additive.

For example, in a case when a powder is barium titanate and a liquid additive is diethylene glycol monomethyl ether (flash point of 93° C.), from a view point of operating efficiency, the drying temperature is typically set to 93 to 200° C., preferably 120 to 200° C. by using a thermostat oven, and the drying time is typically set to two hours or less, preferably 30 minutes to 2 hours. In a case when a liquid additive is ethanol (flash point of 16° C.), from a view point of operating efficiency, the drying temperature is typically set to 16 to 200° C., preferably 120 to 200° C. by using a thermostat oven, and the drying time is typically set to two hours or less, preferably 30 minutes to 2 hours.

When the classifying apparatus 2 is operated, the inhale-blower 12 starts to inhale gas (step S14). Since the gas is inhaled from the inhaling port 32 provided in the middle of the upper portion of the centrifugation chamber 20 into the centrifugation chamber 20, the air pressure in the middle portion of the centrifugation chamber 20 is relatively low. Because of the negative pressure produced in the centrifugation chamber 20 as described above, the atmospheric air, which is an atmospheric pressure gas, is inhaled from each gap between the guide vanes 40 arranged along the outer circumference of the centrifugation chamber 20 to be supplied to the inside of the centrifugation chamber 20 (step S18). The atmospheric pressure gas to be inhaled in the centrifugation chamber 20 is previously heated to a given temperature when the atmospheric pressure gas flows inside the tube provided in the second heater 14 (step S16). The atmospheric pressure gas is inhaled through the gap between the guide vanes 40 as described above. Thereby, a swirling air stream having a flow rate which is determined according to the rotational angle of the guide vane 40 is formed. In the powder-classification method according to the embodiment, the atmospheric pressure gas to be inhaled is heated so as the temperature of the swirling air stream in the centrifugation chamber 20 to be at a desired temperature.

Then, using the compressor 8, supplying of a high-pressure gas to the centrifugation chamber 20 of the classifier 4 starts. The high-pressure gas ejected from the compressor 8 is heated to a given temperature by the first heater 10 (step S20). Similar to the second heater 14, the first heater 10 heats the high-pressure gas so as the temperature of the swirling air stream in the centrifugation chamber 20 to be at a desired temperature. The high-pressure gas heated to a given temperature is ejected from the plurality of ejection nozzles 30 provided in the outer wall of the centrifugation chamber 20 to be supplied to the inside of the centrifugation chamber 20 (step S22).

When a state in which a heated high-speed swirling air stream constantly swirls in the centrifugation chamber 20 is formed as described above, a mixed powder transmitted at a constant flow rate from the feeder 6 is loaded into the centrifugation chamber 20 from the loading port 26 (step S24). The mixed powder to be loaded from the loading port 26 includes a liquid additive which does not have vaporized in the drying step in step S12 described above.

As illustrated in FIG. 2, since the loading port 26 is provided on the upper part of the outer circumference of centrifugation chamber 20, the mixed powder loaded from the loading port 26 dashes against the swirling air stream swirling at a high speed in the outer circumference of centrifugation chamber 20 and is dispersed rapidly. A liquid additive existing between fine particles of the powder rapidly vaporizes to facilitate the dispersion of the powder. The powder dispersed in an unit of a fine particle as described above swirls times out of number in the centrifugation chamber 20 without sticking to the surface of the members constituting the centrifugation chamber 20, such as the upper disk-shaped member 22 and the lower disk-shaped member 24, and is classified based on the grain size of the powder (step S26).

As a result of the effect of centrifugal separation in the centrifugation chamber 20, a fine powder having a grain size of, or smaller than, a desired classification-point is gathered in the middle portion of the centrifugation chamber 20, and collected from the inhaling port 32, together with the gas inhaled by the inhale-blower 12, by the effect of a ring-shape protrusion provided in the middle portion of each of the upper disk-shaped member 22 and the lower disk-shaped member 24 (step S28). A coarse powder having a grain size larger than the classification-point is gathered in the outer circumference of the centrifugation chamber 20 by the effect of centrifugal separation in the centrifugation chamber 20, and then falls from the reclassification zone 28 along the conical shape portion of the classifier 4 and is ejected from the discharge port 34 to be collected in the collecting container 16.

As described above, the powder is efficiently dispersed by the effect of the high temperature swirling air stream swirling in the centrifugation chamber 20 and the liquid additive. The powder swirls in the centrifugation chamber 20 without sticking to the surface of the members constituting the centrifugation chamber 20, and is efficiently classified in a fine powder having a grain size of, or smaller than, a desired classification-point and a residual coarse powder. All the additives supplied to the classifier 4 with the powder vaporize, and therefore are not included in the collected powder.

In the embodiment, the supplied gas is heated so as the temperature of the swirling air stream in the classifier 4 to be at a desired temperature. For example, when the supplied gas is heated so as the temperature of the swirling air stream in the classifier 4 to be at the temperature of, or higher than, the flash point of the liquid additive mixed together with the powder, and 200° C. or lower, the classification can efficiently be carried out.

A powder-classification method according to a second embodiment according to the present invention will be described referring to the drawings. The powder-classification method according to the second embodiment is constituted by deleting the heating step of an atmospheric pressure gas and a high-pressure gas from the powder-classification method according to the first embodiment. Therefore, the detailed description of the same component as the classifying apparatus 2 described above is omitted, and only the portion different from the classifying apparatus 2 will be described in detail. The same reference sign is used for the same component as in the classifying apparatus 2 described above.

Figure 4:
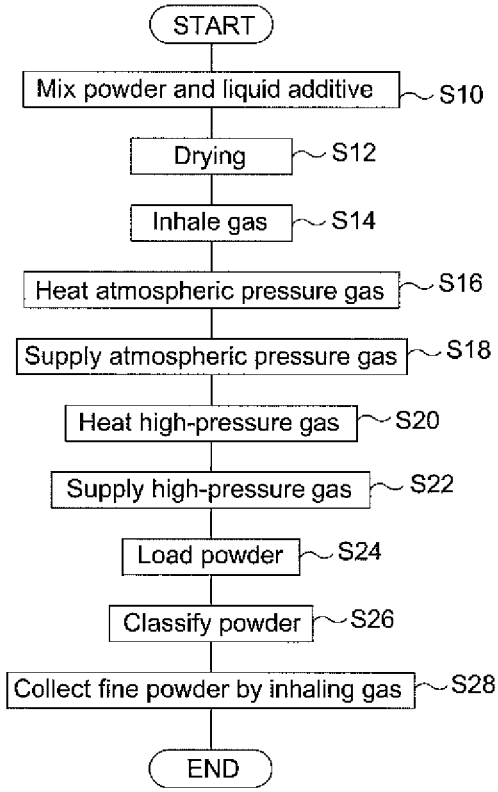
FIG. 4 is a flow chart in which a powder-classification method according to the first embodiment is explained.
Figure 5:
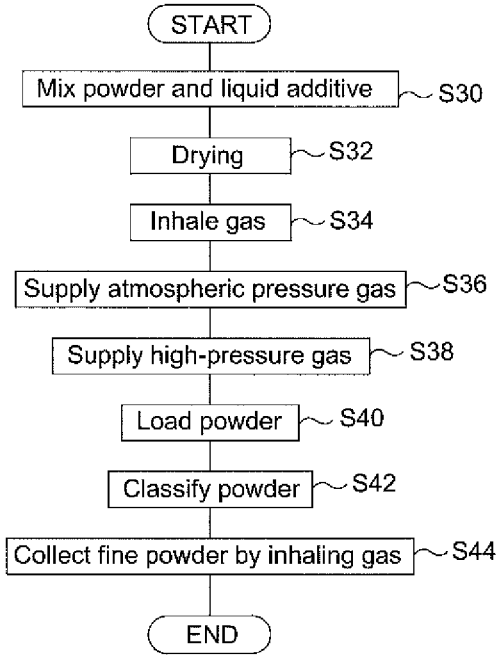
FIG. 5 is a flow chart in which a powder-classification method according to a second embodiment is explained.

FIG. 5 is a flowchart in which a powder-classification method according to the second embodiment is explained. First, a powder to be classified and a liquid additive is mixed together (step S30). Then, the liquid additive is vaporized by drying the mixture of the powder and the liquid additive (step S32). Since each process expressed in step S30 and step S32 is similar to each process expressed in step S10 and step S12 in the flowchart in FIG. 4, respectively, a detailed description of each of the processes expressed in step S30 and step S32 is omitted.

When the classifying apparatus 2 is operated, the inhale-blower 12 starts to inhale a gas (step S34), and an atmosphere gas, which is an atmospheric pressure gas, is supplied to the inside of the centrifugation chamber 20 (step S36). In this manner, the atmospheric pressure gas is inhaled through the gap between the guide vanes 40. Thereby, a swirling air stream having a flow rate which is determined according to the rotational angle of the guide vane 40 is formed. Then, using the compressor 8, supplying of a high-pressure gas to the centrifugation chamber 20 of the classifier 4 starts (step S38). The high-pressure gas is ejected from the plurality of ejection nozzles 30 provided in the outer circumference wall of the centrifugation chamber 20 to be supplied to the inside of the centrifugation chamber 20. In the embodiment, the atmospheric pressure gas and the high-pressure gas are not heated.

When a state in which a high-speed swirling air stream constantly swirls in the centrifugation chamber 20 is formed as described above, a mixed powder transmitted at a constant flow rate from the feeder 6 is loaded into the centrifugation chamber 20 from the loading port 26 (step S40). The loaded mixed powder is classified based on the grain size of the powder (step S42) and collected from the inhaling port 32 together with the gas inhaled by the inhale-blower 12 (step S44). A coarse powder having a grain size larger than the classification-point is ejected from the discharge port 34 and collected in the collecting container 16 in a manner similar to the first embodiment.

Since each process expressed in steps S34, S36, S38, S40, S42, and S44 is similar to each process expressed in steps S14, S18, S22, S24, S26, and S28 in the flowchart in FIG. 4, respectively, a detailed description of each of the processes expressed in steps S34, S36, S38, S40, S42, and S44 is omitted.

In the powder-classification method according to each of the embodiments described above, a powder to be classified is mixed together with a liquid additive, dried, and then loaded into the centrifugation chamber of the classifier. And with a high-speed swirling air stream formed by a gas inhaled in the centrifugation chamber, the powder and the liquid additive disperse uniformly, and thereby classification of the powder having a grain size of 1 μm or smaller can efficiently be carried out.

EXAMPLES

The powder-classification method according to the embodiment will be described in detail referring to Examples.

Example 1

A fine powder of barium titanate (median diameter 0.683 μm, maximum particle diameter 7.778 μm) is used as a powder to be classified. Diethylene glycol monomethyl ether is used as a liquid additive. In the mixing step, diethylene glycol monomethyl ether is added to, and mixed with, the fine powder of barium titanate using a mixer (Hi-X, manufactured by Nisshin Engineering Co., Ltd.). By a mass ratio, 0.05 of diethylene glycol monomethyl ether is added to 1 of barium titanate.

In the drying step, the mixture of barium titanate and diethylene glycol monomethyl ether is dried by ventilation drying at a temperature of 130° C. for two hours in a thermostat oven. The dried mixture is loaded into the classifier.

Classification is carried out using a classifier equipped with a heat insulation, in which the amount of the gas inhaled by the inhale-blower is 2 $m^3$/min and the pressure of a high-pressure gas produced by the compressor is 0.6 MPa. The rate of loading the powder into the classifier is set to 1 kg/h. The atmospheric pressure gas and the high-pressure gas are heated and the temperature in the classifier is set to 100° C. The temperature in the classifier is obtained by measuring the temperature of the gas just after the gas is inhaled from the inhaling port in the classifier by the inhale-blower of the classifying apparatus.

Example 2

Classification is carried out in a manner similar to Example 1, except that the atmospheric pressure gas and the high-pressure gas are not heated and the temperature in the classifier is set to 18° C.

Comparative Example 1

Classification is carried out in a manner similar to Example 1, except that the drying step is not performed.

Comparative Example 2

A fine powder of barium titanate (median diameter 0.683 μm, maximum particle diameter 7.778 μm) is loaded into the classifier without adding or mixing with a liquid additive. The condition of classification in the classifier is similar to Example 1, except that the atmospheric pressure gas and the high-pressure gas are not heated and the temperature in the classifier is set to 16° C.

(Method for Estimation)

For each of the Examples and Comparative Examples, the amounts of loaded barium titanate (based on dried powder) and collected product (fine powder) are measured, and the product yield is obtained. A product grain size (median diameter and maximum particle diameter) of the collected fine powder is measured. The particle diameter is measured using a measuring instrument for measuring the size of a particle (Microtrac MT-3300EX, manufactured by NIKKISO CO., Ltd.). The measured result is shown in Table 1.

TABLE 1

| | amount loaded (based on dried powder) | amount of product collected (fine powder) | product yield | product grain size: median diameter ($D_{50}$) | product grain size: maximum particle diameter ($D_{100}$) |
|---|---|---|---|---|---|
| Example 1 | 938 g | 582 g | 62.0% | 0.473 μm | 1.375 μm |
| Example 2 | 910 g | 490 g | 53.8% | 0.487 μm | 1.375 μm |
| Comparative Example 1 | 922 g | 539 g | 58.5% | 0.467 μm | 1.375 μm |
| Comparative Example 2 | 986 g | 389 g | 39.4% | 0.490 μm | 1.635 μm |

As shown in Table 1, it is discovered that in the case when barium titanate and diethylene glycol monomethyl ether are mixed together and dried, and heated in classification (Example 1), the product yield is equivalent to, or higher than, that of the case without drying before classification (Comparative Example 1).

Further, it is discovered that in the case when barium titanate and diethylene glycol monomethyl ether are mixed together and dried, and not heated in classification (Example 2), the product yield is higher than that of the case without adding of the liquid additive and drying before classification (Comparative Example 2).

Therefore, it is confirmed that the product yield of barium titanate can be raised by including the drying.

In either of Examples 1 and 2 described above, the centrifugal separation is continuously carried out for 30 minutes and the operation is not stopped by blockage. Further, in either of the test results, it is confirmed that the grain size distribution of collected fine powder is equivalent among test results and adding of the liquid additive does not have an effect on the performance of classification itself.

REFERENCE SIGNS LIST

2 . . . classifying apparatus, 4 . . . classifier, 6 . . . feeder, 8 . . . compressor, 10 . . . first heater, 12 . . . inhale-blower, 14 . . . second heater, 20 . . . centrifugation chamber, 22 . . . upper disk-shaped member, lower disk-shaped member, 26 . . . loading port, 30 . . . ejection nozzle, 32 . . . inhaling port, 40 . . . guide vane

The invention claimed is:

1. A powder-classification method comprising:

a mixing step in which a powder and a liquid additive are mixed together;

a drying step in which the powder mixed in the mixing step is dried;

a loading step in which the powder dried in the drying step is loaded into a fluid classifier;

a heating step in which a gas is heated;

a supplying step in which the gas heated in the heating step is supplied to the fluid classifier; and a classifying step in which the powder is classified in the fluid classifier based on a grain size of the powder, wherein a drying temperature and a period of time for drying in the drying step are each determined based on a flash point of the liquid additive.

2. The powder-classification method according to claim 1, wherein, in the heating step, the gas is heated so that a temperature in the fluid classifier is between a flash point of the liquid additive or higher and 200° C. or lower.

3. The powder-classification method according to claim 1, wherein the gas supplied in the supplying step is a high-pressure gas.

4. The powder-classification method according to claim 1, wherein the powder is classified in the classifying step by a swirling air stream produced in the fluid classifier.

5. The powder-classification method according to claim 1, wherein the liquid additive is diethylene glycol monomethyl ether.

6. The powder-classification method according to claim 1, wherein the powder is a powder of barium titanate.

7. A powder-classification method comprising:

a mixing step in which a powder and a liquid additive are mixed together;

a drying step in which the powder mixed in the mixing step is dried;

a loading step in which the powder dried in the drying step is loaded into a fluid classifier;

a supplying step in which a gas is supplied to the fluid classifier; and a classifying step in which the powder is classified in the fluid classifier based on a grain size of the powder, wherein a drying temperature and a period of time for drying in the drying step are each determined based on a flash point of the liquid additive.

8. The powder-classification method according to claim 7, wherein the gas supplied in the supplying step is a high-pressure gas.

9. The powder-classification method according to claim 7, wherein the powder is classified in the classifying step by a swirling air stream produced in the fluid classifier.

10. The powder-classification method according to claim 7, wherein the liquid additive is diethylene glycol monomethyl ether.

11. The powder-classification method according to claim 7, wherein the powder is a powder of barium titanate.

* * * * *